US007625480B2

(12) United States Patent
Beattie et al.

(10) Patent No.: US 7,625,480 B2
(45) Date of Patent: Dec. 1, 2009

(54) PYROLYSIS FURNACE FEED

(75) Inventors: David Beattie, Perth (GB); Richard Charles Stell, Houston, TX (US); James N. McCoy, Houston, TX (US); Bryan Daniel McVicker, Houston, TX (US); Paul F. Keusenkothen, Houston, TX (US); Alok Srivastava, Houston, TX (US); David Bleckinger, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 148 days.

(21) Appl. No.: 11/432,260

(22) Filed: May 11, 2006

(65) Prior Publication Data

US 2007/0261991 A1 Nov. 15, 2007

(51) Int. Cl.
*C10G 9/00* (2006.01)
*C10G 15/00* (2006.01)

(52) U.S. Cl. ..... 208/106; 208/48 R; 208/125; 208/128; 208/130; 208/132; 208/652; 585/647; 585/648; 585/652

(58) Field of Classification Search ..... 208/106, 208/48 R, 125, 128, 130, 132, 652; 585/647, 585/648, 652
See application file for complete search history.

(56) References Cited

U.S. PATENT DOCUMENTS

| | | | | |
|---|---|---|---|---|
| 3,532,542 | A * | 10/1970 | Shimizu et al. | 134/20 |
| 3,707,459 | A | 12/1972 | Mason et al. | 208/76 |
| 3,922,216 | A | 11/1975 | Wilson et al. | 208/72 |
| 4,178,228 | A | 12/1979 | Chang | 208/72 |
| 4,397,740 | A * | 8/1983 | Koontz | 208/48 Q |
| 4,931,164 | A | 6/1990 | Dickakian | 208/48 AA |
| 5,443,715 | A | 8/1995 | Grenoble et al. | |
| 6,013,852 | A | 1/2000 | Chandrasekharan et al. | 585/648 |
| 7,220,887 | B2 * | 5/2007 | Stell et al. | 585/647 |
| 2004/0004022 | A1 | 1/2004 | Stell et al. | |
| 2005/0261535 | A1 | 11/2005 | Beattie et al. | 585/648 |

FOREIGN PATENT DOCUMENTS

| | | |
|---|---|---|
| DE | 218 116 | 1/1985 |
| DE | 222 324 | 5/1985 |
| GB | 2 006 259 | 2/1979 |
| WO | WO 2005/113722 | 12/2005 |

OTHER PUBLICATIONS

Moore et al., "Next Generation Polyalphaolefins—the Next Step in the Evolution of Synthetic Hydrocarbon Fluids," www.innovene.com, Innovene USA LLC, (Nov. 22, 2005).

* cited by examiner

*Primary Examiner*—In Suk Bullock
*Assistant Examiner*—Prem C. Singh

(57) ABSTRACT

The invention relates to a method for processing asphaltene-containing feed to a pyrolysis furnace by raising the final boiling point of the feed/steam mixture to the pyrolysis furnace to ensure fouling occurs lower in the convection section where the mixture of air and steam can burn off fouling deposits during decoking operations. The final boiling point of the feed stream is increased by adding a heavy essentially asphaltene-free high boiling point hydrocarbon to the feed stream before the feed stream enters the convection section of the pyrolysis furnace, whereby said fouling occurs lower in the convection section.

27 Claims, 2 Drawing Sheets

PYROLYSIS FURNACE FEED

FIELD OF THE INVENTION

The invention relates to a method for processing asphaltene-containing feed to a pyrolysis furnace.

BACKGROUND OF THE INVENTION

Crude oils and fractions thereof are typically processed first by fractionating in a refinery and then by cracking, such as in a pyrolysis furnace, to yield various products including the light olefins ethylene, propylene, and butylenes.

Conventional steam cracking utilizes a pyrolysis furnace which has two main sections: a convection section and a radiant section. The feedstock typically enters the convection section of the furnace where it is heated and vaporized by indirect contact with hot flue gas from the radiant section and by direct contact with steam. The vaporized feedstock and steam mixture is then introduced into the radiant section where the cracking takes place. The resulting products, including the valuable light olefins mentioned above, leave the pyrolysis furnace for further downstream processing, including quenching and recovery from one or more fractionating columns/towers.

The crude oils and fractions thereof which contain asphaltenes and other heavy molecules having a high final boiling point (FBP) cannot be used directly as feed in conventional steam cracking processes because the asphaltenes will become fouling precursors in the pyrolysis furnace. The fouling is in the form of coke deposits and the like, which negatively affect the furnace performance due to increased pressure drop, reduced heat transfer, plugging, and other problems.

Materials such as condensates and naphthas are often contaminated by heavy molecules having a high FBP. For instance, condensates and naphthas are often transported in containers such as ships which have previously contained crude oil, heavy gas oil, resids, and the like, having FBP greater than 950° F. (510° C.) and small but significant amount of material having FBP of 1200° F. (650° C.) and higher. Condensates may also be obtained from the gasfields contaminated with these high FBP molecules. Once contaminated, these materials have decreased value as pyrolysis furnace feeds because they cause fouling. The location of the fouling is the key problem for subsequent decoking operations.

The present inventors have noted that the problem of fouling in a pyrolysis furnace is particularly acute with pyrolysis feed fractions containing light molecules in addition to the heavy foulant molecules. In this instance, the specific problem is that that foulant deposits (often referred to as "coke") are formed in the tube banks located in the upper part of the convection section of the pyrolysis furnace which cannot be removed during decoking operations. The problem applies to furnaces with and without transfer line exchangers used to quench the furnace effluent (hereinafter "TLE furnace").

With TLE furnaces, deposits may form above the HP (high pressure) steam superheater rows of the furnace convection section. During decoking operations, the temperature of the furnace (and thus the temperature of the air/steam decoking mixture) above the HP steam superheater rows is too cold to burn the coke deposits. The temperature in the upper convection section (and thus the temperature of the air/steam decoking mixture) is generally too low to facilitate decoking because of the energy used in heating the saturated steam in the HP steam superheating tubes located between the upper and lower convections section tube banks. As a result, coke that deposits in the tubes in the lower temperature regions of the convection section can only be removed by first shutting down and cooling the furnace, and then hydroblasting to remove the coke. This mechanical cleaning is expensive, not the least of the expense due to lost production time.

In the past, the above mentioned problems could be addressed by redistilling the feed material to obtain clean feed, but this is an energy intensive and wasteful solution. Diluting the contaminated feed with clean feed is a known procedure, but this does not solve the problem of deposits laying down in tube bank locations that are inaccessible to ordinary decoking operations. More generally, contamination problems in refinery and/or pyrolysis feeds have been addressed by various methods such as membrane separation (U.S. Pat. No. 6,013,852); addition of materials such as an oil soluble overbased magnesium sulphonate (U.S. Pat. No. 4,931,164), a "free-radical acceptor", e.g., n-heptane (U.S. Pat. No. 3,707,459), toluene (DD 222324), coal-derived gasoline (DD 218116), or deisobutanized C3 to C5 paraffin stream (U.S. Pat. No. 3,922,216); recycling of a portion of the product, such as naphtha from the cracked product stream (U.S. Pat. No. 4,178,228); and pretreatments such as hydrogenation of heavier fractions (GB 2006259). These methods suffer, among other reasons, by not being generally applicable to feeds comprising crude or crude fractions, not solving the problem of coking on modern equipment, and/or being inefficient.

U.S. Patent Application 2005/0261535 describes a method of processing light hydrocarbon feedstock containing non-volatile components and/or coke precursors comprising flashing the feed in a flash/separation vessel (whereby asphaltenes are removed in the liquid phase) and cracking the asphaltene-free vapor phase of said flash/separation vessel.

The present inventors have surprisingly discovered that mixing heavy feed with contaminated light feed enables decoking of the foulant and eliminates the need for costly mechanical decoking of a pyrolysis furnace.

SUMMARY OF THE INVENTION

The invention is directed to a method of reducing or eliminating the need for mechanical decoking of a pyrolysis furnace by lowering the convection section location where the foulant deposits forms and/or causing the deposits to form in areas of higher temperature in the convection section. This can be achieved by admixing heavier higher boiling feeds with lighter contaminated feeds.

The boiling temperature range of the feed/steam mixture to the pyrolysis furnace is raised by adding a high boiling point hydrocarbon material with low-to-nil asphaltenes to the feed. Surprisingly, the hydrocarbon material can have more asphaltenes than the asphaltene-contaminated lighter feed as long as the mixture does not significantly decrease runlength (runlength defined herein as being the period of operation of the pyrolysis furnace before the operations are modified to allow air/steam decoking). However, an asphaltene-free heavy hydrocarbon is preferred because it will dilute the base feed asphaltenes and improve furnace runlength. Note that typically the furnace is not shutdown before decoking; rather, in preferred decoking operations, a series of valves are opened and closed to clear the furnace of hydrocarbon, then air and steam are introduced for decoking.

In even more preferred embodiment, the material added to feed is selected from a high boiling waxy basestock such as 600N, 1200N, or a heavy low-asphaltene hydrocarbon such as hydrocrackate. The 600N and 1200N are neutral ("N") basestocks varying by viscosity and/or pour points and are terms well-known in the art.

It is a further object of the invention to make use of contaminated condensate from gasfields and contaminated naphtha as feed to a pyrolysis furnace without resorting to distillation or dilution with clean feed.

It is also an object of the invention to increase the decokability of a pyrolysis furnace, particularly in a TLE furnace, that is used to crack a contaminated feed.

These and other objects, features, and advantages will become apparent as reference is made to the following detailed description, preferred embodiments, examples, and appended claims.

DETAILED DESCRIPTION

Figure 1:
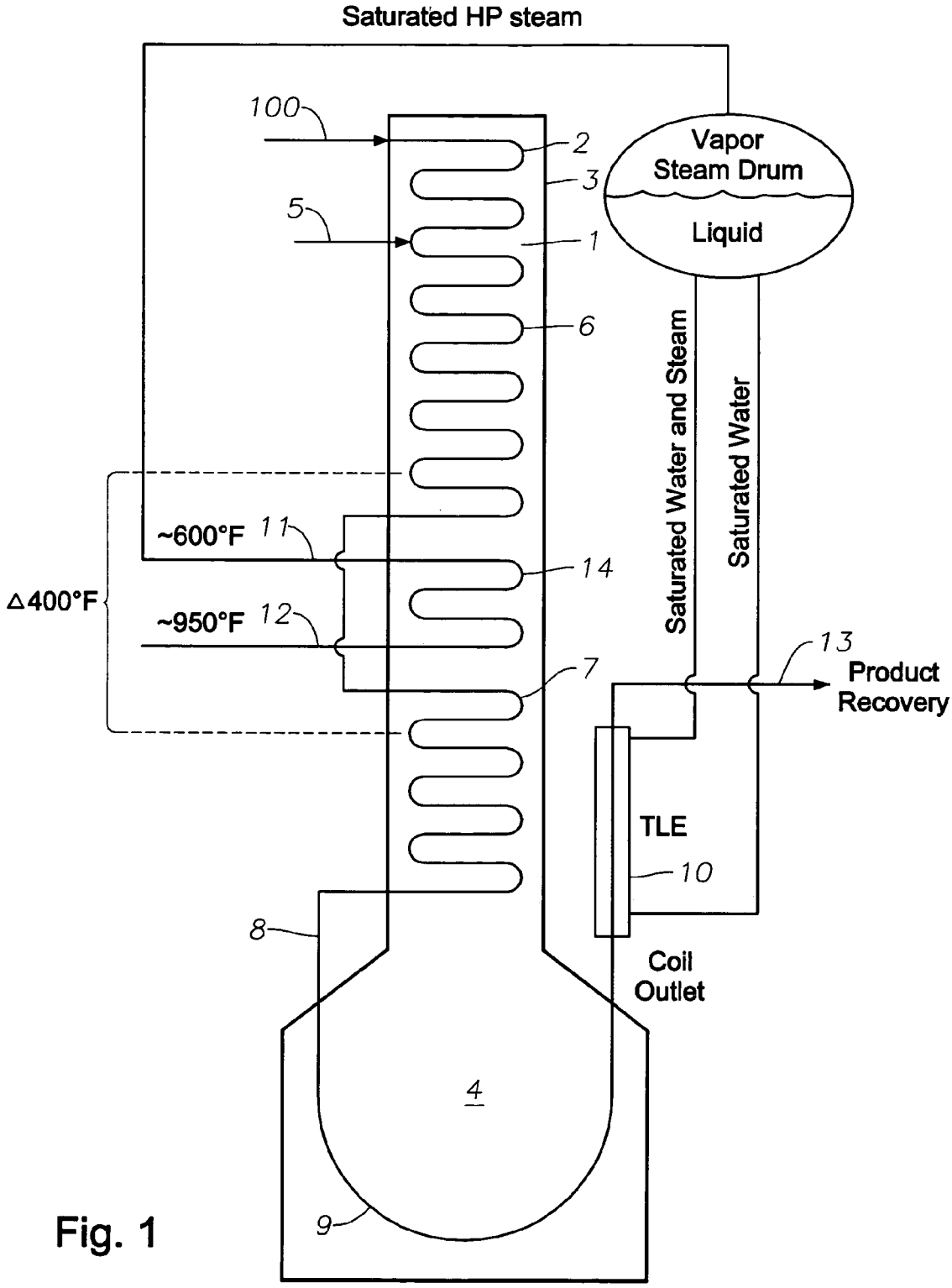
FIG. 1 is a schematic flow diagram of the overall process in accordance with the present invention, employing a TLE Furnace.

According to the invention, a high boiling point hydrocarbon is mixed with an asphaltene-containing feed so as to provide to the inlet of a pyrolysis furnace a combined feed stream, cracking said combined feed stream in the presence of steam, at elevated temperature, and removing from the cracking furnace a cracked stream enriched in light olefins.

In a preferred embodiment the asphaltene-containing feed comprises a material selected from condensate, naphtha, and mixtures thereof, which has been contaminated by asphaltenes.

By "light olefins" is meant at least one of ethylene, propylene and butylenes.

By "contaminated feed" is meant: (a) asphaltene-containing light feed; or (b) that the feed, such as condensate and/or naphtha, was at one time asphaltene-free, e.g. it was obtained from a refinery operation that removed asphaltene or it was condensate obtained from a gasfield, but that downstream from the refinery or gasfield the material has been come into contact with and mixed with a small but significant amount of 1200° F.+ (650° C.+) materials and then becomes "contaminated feed"; or (b) that the feed was obtained from a refinery contaminated with a small but significant amount of 1200° F.+ (650° C.+) material due to, by way of example, an upset in the refinery distillation process, or it was obtained contaminated from a gasfield with a small but significant amount of 1200° F.+ (650° C.+) material.

The term "asphaltene" as used herein means a material obtainable from crude oil and having an initial boiling point above 1200° F. (650° C.) and which is insoluble in a paraffinic solvent. The term "asphaltene-free" means a material obtainable from a refinery fractionation process or gasfield below a final boiling point of 1200° F. (650° C.) and that, by itself, will leave essentially no fouling material in the convection section of a pyrolysis furnace.

By "high boiling hydrocarbon" is meant means a hydrocarbon boiling at a sufficient temperature such that the final boiling point of the combined feed (asphaltene-containing feed and high boiling hydrocarbon) is increased relative to the asphaltene-containing feed prior to addition of the high boiling point hydrocarbon.

FBP may be determined by either ASTM D-6352-98 or ASTM D-2887.

By "condensate" is meant the heaviest fraction from a natural gas field that, after capture, is in the liquid phase at surface pressure and temperature.

By "naphtha" is meant a material obtainable as a distillate of petroleum with a boiling range of approximately 70 to 400° F. (20 to 205° C.).

In preferred embodiments, the final boiling point (FBP) temperature that the feed will be raised is to about 700° F. (370° C.) and above, preferably in the range of about 700 to about 1000° F. (540° C.) or even higher. In other preferred embodiments, the final boiling point temperature of the feed will be raised about 25° F. (14° C.) or about 100° F. (56° C.) or about 200° F. (110° C.) or about 400° F. (220° C.) by addition of the high boiling point hydrocarbon.

The quantity of high boiling point hydrocarbon to be added will be an amount sufficient to raise the final boiling point of the contaminated feed/steam mixture, which can be determined by routine experimentation by one of ordinary skill in the art in possession of the present disclosure. The FPB of the heavy hydrocarbon is determined by an ASTM D-2887 distillation. This may be further aided by vapor/liquid simulations using commercially available software, such as PR0/II™ available from Simulation Sciences Inc.

The "small but significant amount of 1200° F.+ (650° C.+) contaminant" will be an amount sufficient to cause fouling but preferably an amount of asphaltenes below a CCR (Conradson Carbon Residue) spec or an equivalent measurement of asphaltene content. The method of determining the asphaltene content of the feed prior to mixing with the final boiling point-raising high boiling point hydrocarbon may be determined by any method known to those skilled in the art, such as CCR. CCR is a well known measurement of resid content according to ASTM D-189. Typical refinery operations specify a CCR content for feed which establishes a maximum resid content, measured in percent by weight (wt %) based on the weight of the feed, which may be, by way of example, 0.10 wt %, 0.05 wt %, 0.02 wt %. 0.1 wt %, less than 0.01 wt %, etc.

While the feed may be more heavily contaminated than suggested in the above paragraph, the present invention is most advantageously applied to feeds that are only lightly contaminated. A more important consideration is the final level of asphaltene. Thus, in preferred embodiments, the combined feed does not contain large amounts of heavy contamination. This is because the convection section runlength tends to be inversely proportional to the concentration of the contaminants, and lengthy runlengths are ordinarily preferred.

According to the process of the invention, a heavy, essentially asphaltene-free hydrocarbon is mixed with the contaminated feed, such as condensate or naphtha or mixtures thereof. The essentially asphaltene-free hydrocarbon will be added in an amount sufficient to increase the boiling temperature range of the feed, as discussed in more detail above.

The mixing of high boiling essentially asphaltene-free hydrocarbon and contaminated feed should occur prior to entering the convection section of the pyrolysis furnace. The mixing can be accomplished by known methods.

The addition of the essentially asphaltene-free hydrocarbon material will, in preferred embodiments increase the boiling temperature of the mixture stream and thus lower the convection section location where foulant deposits form. At the boiling point higher temperature, lower location in the convection section, during ordinary decoking operations, the air/steam decoking mixture is hot enough to burn the coke deposits.

The nature and quantity of the asphaltene-free hydrocarbon material added to the feed stream can be determined by one of ordinary skill in the art in possession of the present disclosure without more than routine experimentation (which may include use of commercially available simulation software). Preferred examples are provided herein.

In the various preferred embodiments, the high boiling point hydrocarbon added to the contaminated feed may be selected from at least one of hydrocrackate, waxy basestock, atmospheric gasoil, hydrotreated gasoil, vacuum gasoil; and the contaminated feed is selected from at least one of condensate, naphtha, and raffinate.

Without wishing to be bound by theory, the advantages of the present invention are best realized when the added high boiling point hydrocarbon is "asphaltene-free" and increases the final boiling point of the combined feed/steam stream whereby fouling deposits are moved to a location in the pyrolysis furnace where the fouling deposits can be air/steam decoked (lower in the convection section where the temperature of the convection section is hot enough to facilitate decoking).

Another advantage of the present invention is that in certain embodiments the high boiling point hydrocarbon material added to the contaminated feed increases the valuable product obtained (e.g., olefins) in the cracking process, e.g., if the material added is a crude-based highly paraffic material such as wax (albeit low-to-nil asphaltenes, or inherently asphaltene-free). This is a particular advantage over prior art methods adding salts or very light materials such as toluene.

Another advantage of the present invention is that the high boiling hydrocarbon material added according to the process of the present invention does not need to be hydrogenated, nor does it need to be aromatic-free, provided of course that it contains essentially low-to-nil asphaltenes, or is inherently asphaltene-free at its source, such as heavy vacuum gasoil (VGO). Note that high boiling point hydrocarbon additives may contain a large amount of aromatics when a quench header furnace is used; however, typically it is advantageous that neither the high boiling hydrocarbon nor the contaminated feed contain significant amounts of heavy aromatics.

The definition of the term "low-to-nil" depends on what is considered an acceptable runlength for a particular operation, but a good starting point is approximately a CCR of 0.01 wt % or less but amounts as high as 0.05 wt % may be acceptable.

The following examples are meant to illustrate the present invention. Numerous modifications and variations are possible and it is to be understood that within the scope of the appended claims, the invention may be practiced otherwise than as specifically described herein.

FIG. 1 is a schematic flow diagram of the overall process in accordance with the present invention, employing a TLE Furnace. The contaminated hydrocarbon feedstock is mixed with the final boiling point-increasing high boiling point hydrocarbon to produce the hydrocarbon feedstock mixture (hereinafter "hydrocarbon mixture") having a final boiling point higher than the final boiling point of the contaminated hydrocarbon feed prior to mixing. The mixture stream is then introduced to the pyrolysis furnace through the inlet 100. The hydrocarbon mixture is heated in the upper convection section 3 in tube bank 2 of the pyrolysis furnace 1 (which is farthest from the radiant section 4 and thus cooler than the lower convection tube banks). The heat is supplied by the hot flue gases from the radiant section 4 of the furnace 1. Mixing of the contaminated hydrocarbon feedstock and the high boiling point hydrocarbon is conveniently accomplished by mixing streams of the respective materials in piping, by inline mixers, by values, at pump suction or in tankage (the details of which are not part of the present invention and hence not shown in the drawings) upstream of the inlet 100. The heated hydrocarbon mixture typically has a temperature between about 212 and about 650° F. (about 100 and about 340° C.).

The heated hydrocarbon mixture is mixed with primary dilution steam stream 5. A preferred source of the steam is process steam condensate. It will be appreciated by one of ordinary skill in the art that the mixing of the heated hydrocarbon mixture and primary dilution steam can occur inside or outside the pyrolysis furnace 1. Likewise, the mixing of the contaminated hydrocarbon feedstock and high boiling point hydrocarbon may occur inside pyrolysis furnace 1. Various options will become immediately apparent to one of ordinary skill in the art in possession of the present disclosure and it will be recognized that the features of FIG. 1 are merely one embodiment, albeit preferred.

The primary dilution steam introduced through piping 5 can have a temperature greater, lower or about the same as the hydrocarbon mixture but preferably the temperature is about the same as that of the hydrocarbon mixture. The primary dilution steam may be superheated before being injected into the hydrocarbon mixture. The mixture stream comprising the heated hydrocarbon mixture and the primary dilution steam stream is heated further in the convection section of the pyrolysis furnace 1. The heating can be accomplished, by way of non-limiting example, by passing the mixture stream through a second bank of heat exchange tubes 6 located within the convection section below the first tube bank 2, thus heated by the hot flue gas from the radiant section 4 of the furnace.

As shown in FIG. 1, saturated HP steam may be conveniently introduced through piping 11 into tube bank 14 located between tube banks 6 and 7, in order to increase the temperature of the saturated HP steam several hundreds of degrees between its entrance into the furnace 1 through piping 11 and its exit through piping 12. By way of example the HP steam in piping 11 may be 600° F. and 1500 psig and the steam in piping 12 may be 950° F. This steam does not come in contact with the hydrocarbon mixture in piping 100. The difference between the flue gas temperature in lower portion of tube bank 6 and the upper portion of tube bank 7 may be from several tens to hundreds of degrees (400° F. or 220° C. is shown in the example). This temperature difference is in part attributable to the energy used to superheat the saturated steam in tube bank 14. In the prior art method, the processing of the contaminated hydrocarbon feed, without the final boiling point increasing high boiling hydrocarbon, would result in the deposition of coke in the first and/or second bank of convection section heat exchange tubes, e.g., tube banks 6 after dilution steam injection. According to the invention, the addition of the final boiling point increasing high boiling hydrocarbon results in coke depositing lower in the furnace 1, such as at least one series of heat exchange tubes, e.g., to heat exchange tube banks 7, or more generally, to a point lower in the furnace 1 where the temperature is higher which facilitates coke removal with an air/steam mixture. This is a principal object of the invention.

In a first example of the present invention, the contaminated feedstock is condensate having about 0.01 wt % CCR which is mixed with 5 wt % 600N (based on the weight of the entire combined feed). Prior to the addition of the high boiling point hydrocarbon (the 600N) fouling occurs tube bank 6. After blending with 5 wt % 600N, deposition of coke now occurs in tube bank 7 and not in tube bank 6. For the reasons discussed above, tube bank 7 is much more conveniently decoked during normal decoking operations.

The heated mixture stream leaving tube bank 7 then enters the radiant section 4 of furnace 1 through piping 8 feeding radiant coil 9, where it is cracked to produce an effluent 13 comprising olefins, including ethylene and other desired light olefins, and byproducts.

In a second example of the present invention, the contaminated feedstock is condensate having <0.01 wt % CCR which is mixed with 10 wt % Hydrocrackate. Prior to the addition of the high boiling point hydrocarbon (the Hydrocrackate), the final boiling point of the contaminated feed is 700° F. (370° C.) and fouling/coke deposition occurs in the lower portion of tube bank 6. After blending with 10 wt % Hydrocrackate, the final boiling point of the hydrocarbon mixture is 742° F. (395° C.) and deposition of coke now occurs in tube bank 7 and not in tube bank 6. As previously stated, tube bank 7 is much more conveniently decoked during normal decoking operations.

The heated mixture leaving tube bank 7 then enters the radiant section 4 of furnace 1 through piping 8 feeding radiant coil 9, where it is cracked to produce an effluent 13 comprising olefins, including ethylene and other desired light olefins, and byproducts.

In the embodiment shown in FIG. 1, subsequent to the radiant section 4, the effluent from radiant coil 9 enters a TLE 10 for quenching. The mechanical details of the TLE quench unit 10 are not per se an aspect of the present invention.

Figure 2:
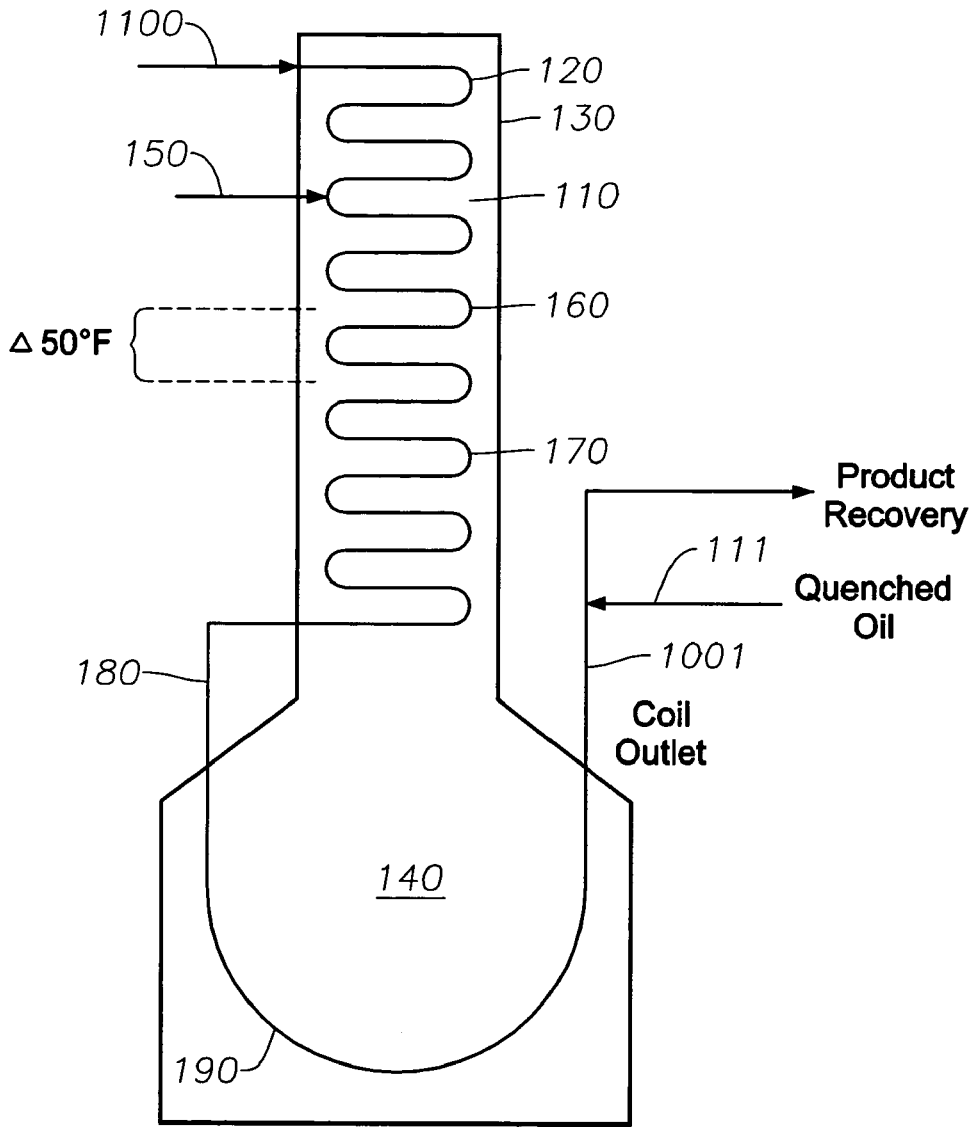
FIG. 2 is a schematic flow diagram of the overall process and apparatus in accordance with the present invention, employing a quench pyrolysis furnace with a quench-oil direct quench system ("Quench-oil furnace").

A second embodiment of the invention is shown in FIG. 2. FIG. 2 is a schematic flow diagram of the overall process and apparatus in accordance with the present invention, employing a Quench-oil furnace.

Similar to the operation of the TLE furnace detailed above, the contaminated hydrocarbon feedstock is mixed with the final boiling point increasing high boiling point hydrocarbon to produce a contaminated hydrocarbon feedstock mixture ("hydrocarbon mixture") and is introduced to the pyrolysis furnace through the inlet 1100. The hydrocarbon mixture is heated in the upper convection section 130 in tube bank 120 of the pyrolysis furnace 110, farthest from the radiant section 140. The heat is supplied by the hot flue gases from the radiant section 140 of the furnace 1. As in the TLE example, mixing of the contaminated hydrocarbon feedstock and the final boiling point-increasing high boiling point hydrocarbon in the quench furnace is conveniently accomplished by mixing streams of the respective materials in piping, by inline mixers, by values, at pump suction or in tankage (not shown) upstream of the inlet 1100. The heated hydrocarbon mixture typically has a temperature between about 212 and about 650° F. (about 100 and about 340° C.).

The heated hydrocarbon mixture is mixed with primary dilution steam introduced through piping 150. A preferred source of the steam is process steam condensate. It will be appreciated by one of ordinary skill in the art that the mixing of the heated hydrocarbon mixture and primary dilution steam can occur inside or outside the pyrolysis furnace 110. Likewise, the mixing of the contaminated hydrocarbon feedstock and high boiling point hydrocarbon may occur inside pyrolysis furnace 110. Again, various options will become immediately apparent to one of ordinary skill in the art in possession of the present disclosure and it will be recognized that these features of FIG. 2 are merely an embodiment, albeit preferred.

The primary dilution steam introduced through piping 150 can have a temperature greater, lower or about the same as the hydrocarbon mixture but preferably the temperature is about the same as that of the hydrocarbon mixture. The primary dilution steam may be superheated before being injected into the hydrocarbon mixture. The mixture stream comprising the heated hydrocarbon mixture and the optional primary dilution steam is optionally heated further in the convection section of the pyrolysis furnace 110. The heating can be accomplished, by way of non-limiting example, by passing the mixture stream through a second bank of heat exchange tubes 160 located within the convection section below the first tube bank 120, thus heated by the hot flue gas from the radiant section 140 of the furnace 110.

As shown in FIG. 2, the heated mixture stream then continues down the furnace 110 to a third tube bank 170. By way of example the flue gas temperature difference between the lower portion of tube bank 160 and the upper portion of tube bank 170 may be about 50° F. (28° C.).

In the prior art method, the processing of the contaminated hydrocarbon feed, without the final boiling point-increasing high boiling hydrocarbon, would result in the deposition of the foulant or coke in the first and/or second bank of heat exchange tubes, e.g., 120 or 160. According to the invention, the addition of the final boiling point-increasing high boiling hydrocarbon increases the final boiling point of the contaminated feedstock to a point sufficient to move the deposition of coke down the furnace 110, such as down at least one series of heat exchange tubes, e.g., to heat exchange tube banks 160 and or 170, respectively, or more generally, to a point lower in the furnace 110 where the temperature is higher and the coke may be removed during decoking operations. Again, this is a principal object of the invention.

In one example, the feedstock is contaminated naphtha having <0.01 wt % CCR, which is mixed with 5 wt % hydrocrackate. Prior to the addition of the high boiling point hydrocarbon (the hydrocrackate), fouling occurs tube bank 160. After blending with 5 wt % hydrocrackate, deposition of coke now occurs in tube bank 170 and not in tube bank 160. Tube bank 170 is much more conveniently decoked during normal decoking operations.

The heated hydrocarbon mixture leaving tube bank 170 then enters the radiant section 140 of furnace 110 through piping 180 feeding radiant coil 190, where it is cracked to produce an effluent 1001 comprising olefins, including ethylene and other desired light olefins, and byproducts.

In the embodiment shown in FIG. 2, subsequent to the radiant section 140, the radiant section effluent 1001 is mixed with a quench oil injected through piping 111 for quenching. The quench oil may conveniently be a material having a boiling point of, by way of example, 435 to 535° F. (225 to 280° C.).

The meanings of terms used herein shall take their ordinary meaning in the art (except in so far as a term may be expressly defined herein); reference shall be taken, in particular, to Handbook of Petroleum Refining Processes, Third Edition, Robert A. Meyers, Editor, McGraw-Hill (2004). In addition, all patents and patent applications, test procedures (such as ASTM methods), and other documents cited herein are fully incorporated by reference to the extent such disclosure is not inconsistent with this invention and for all jurisdictions in which such incorporation is permitted. Also, when numerical lower limits and numerical upper limits are listed herein, ranges from any lower limit to any upper limit are contemplated. Note further that Trade Names used herein are indicated by a ™ symbol or ® symbol, indicating that the names may be protected by certain trademark rights, e.g., they may be registered trademarks in various jurisdictions.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

What is claimed is:

1. A process comprising:

(a) mixing a feed stream comprising an asphaltene-containing crude oil or condensate, or fraction thereof, with a final boiling point-increasing high boiling hydrocarbon containing low-to-nil asphaltenes which provide the high boiling hydrocarbon with a CCR as high as 0.05 wt %, to obtain a hydrocarbon mixture;

(b) cracking said hydrocarbon mixture in a pyrolysis furnace comprising a convection section comprising high pressure superheater exchanger tubes located between an upper convection section tube bank directly communicating with a lower convection section tube bank, and a radiant section;

(c) recovering a cracked effluent from said pyrolysis furnace; and (d) decoking said convection section using an air/steam decoking mixture without shutting down the pyrolysis furnace;

wherein the high boiling hydrocarbon is mixed with the feed stream in an amount sufficient to lower to the lower convection section tube bank, the location at which foulant deposits form in the convection section of the pyrolysis furnace and/or cause foulant deposits to form at higher temperatures in the convection section of the pyrolysis furnace, as compared to the feed stream alone.

2. The process of claim 1, wherein said pyrolysis furnace is a TLE furnace.

3. The process of claim 1, wherein said pyrolysis furnace is a quench-oil furnace.

4. The process of claim 1, wherein said final boiling point-increasing high boiling hydrocarbon is selected from the group consisting of a high boiling waxy basestock, hydrocrackate, atmospheric gasoil, hydrotreated gasoil, vacuum gasoil, and mixtures thereof.

5. The process of claim 1, wherein the final boiling point temperature of said feed stream before mixing with said final boiling point-increasing high boiling hydrocarbon is below 700° F. (370° C.) and the final boiling point of said hydrocarbon mixture is above 700° F. (370° C.).

6. The process of claim 1, wherein the final boiling point temperature of said feed stream before mixing with said final boiling point-increasing high boiling hydrocarbon is below 650° F. (343° C.) and the final boiling point temperature of said hydrocarbon mixture is above 700° F. (400° C.).

7. The process of claim 1, wherein the final boiling point temperature of said hydrocarbon mixture is about 25° F. (14° C.) higher than the final boiling point temperature of said feed stream prior to said mixing.

8. The process of claim 1, wherein the final boiling point temperature of said hydrocarbon mixture is about 200° F. (111° C.) higher than the final boiling point temperature of said feed stream prior to said mixing.

9. The process of claim 1, wherein the final boiling point temperature of said hydrocarbon mixture is about 400° F. (222° C.) higher than the final boiling point temperature of said feed stream prior to said mixing.

10. The process of claim 1, including a step prior to step (a) wherein said feed stream comprising an asphaltene-containing crude oil or condensate, or fraction thereof is contaminated with a small but significant amount of 1200° F.+ (650° C.+) contaminant.

11. The process of claim 10, wherein said step prior to step (a) occurs during at least one process step selected from the group consisting of (i) a shipping process, (ii) a refinery process, and (iii) a gas field process.

12. The process of claim 1, wherein said feed stream prior to said mixing has a maximum resid content of not greater than 0.1 wt % CCR.

13. The process of claim 1, further comprising mixing steam with said feed stream and said final boiling point-increasing high boiling point hydrocarbon.

14. A process for cracking a hydrocarbon feed stream, in a pyrolysis furnace having a radiant section and a convection section, comprising:

(a) mixing said hydrocarbon feed stream which contains asphaltenes with a heavy asphaltene-free hydrocarbon to obtain a hydrocarbon mixture stream having a final boiling point higher than the final boiling point of said hydrocarbon feed stream;

(b) preheating said hydrocarbon mixture stream in a first convection section tube bank to form a preheated hydrocarbon mixture stream;

(c) injecting primary dilution steam into said preheated hydrocarbon mixture stream to form a mixture stream;

(d) heating said mixture stream from step (c) in at least one additional convection section tube bank to form a heated mixture stream;

(e) cracking said heated mixture stream in said radiant section of said pyrolysis furnace to form pyrolysis effluent;

(f) cooling said pyrolysis effluent;

(g) decoking said at least one additional convection section tube bank using an air/steam decoking mixture without shutting down the pyrolysis furnace;

wherein the heavy asphaltene-free hydrocarbon is mixed with the feed stream in an amount sufficient to lower the location at which foulant deposits form in the convection section of the pyrolysis furnace and/or cause foulant deposits to form at higher temperatures in the convection section of the pyrolysis furnace, as compared to the feed stream alone.

15. The process of claim 14 where said hydrocarbon feed stream comprises an asphaltene-containing crude oil or condensate, or a fraction thereof.

16. The process of claim 14 where said heavy, asphaltene-free hydrocarbon is selected from the group consisting of a high boiling waxy basestock, hydrocrackate, atmospheric gas oil, and mixtures thereof.

17. The process of claim 14 wherein the final boiling point temperature of the hydrocarbon feed stream, before mixing with said heavy asphaltene-free hydrocarbon, is below 700° F. (370° C.).

18. The process of claim 14 wherein the final boiling point temperature of the hydrocarbon feed stream, before mixing with said heavy asphaltene-free hydrocarbon, is below 650° F. (343° C.).

19. The process of claim 14 wherein the final boiling point temperature of said hydrocarbon mixture stream is at least about 25° F. (14° C.) higher than the final boiling point temperature of said hydrocarbon feed stream.

20. The process of claim 14 wherein the final boiling point temperature of said hydrocarbon mixture stream is at least about 200° F. (111° C.) higher than the final boiling point temperature of said hydrocarbon feed stream.

21. The process of claim 14, including a step prior to step (a) wherein said feed stream comprising an asphaltene-containing crude oil or condensate, or fraction thereof is contaminated with a small but significant amount of 1200° F.+ (650° C.+) contaminant.

22. The process of claim 21, wherein said step prior to step (a) occurs during at least one process step selected from the group consisting of (i) a shipping process, (ii) a refinery process, and (iii) a gas field process.

23. The process of claim 14 wherein said hydrocarbon feed stream prior to mixing with said heavy asphaltene-free hydrocarbon has a maximum resid content of not greater than about 0.1 wt % CCR.

24. The process of claim 14 where said pyrolysis effluent is cooled using a TLE.

25. The process of claim 14 wherein said pyrolysis effluent is cooled with quench-oil.

26. The process of claim 1 wherein said hydrocarbon mixture resulting from mixing the feed stream with the high boiling hydrocarbon, contains 5 wt % to 10 wt % of the high boiling hydrocarbon.

27. The process of claim 1 wherein said feed stream is selected from condensate, naphtha, and mixtures thereof, contaminated by asphaltenes, and said high boiling point hydrocarbon is selected from high boiling waxy basestock and hydrocrackate.

* * * * *